United States Patent [19]

Crainich

[11] Patent Number: 4,565,386

[45] Date of Patent: Jan. 21, 1986

[54] SKI

[75] Inventor: Lawrence Crainich, Stratford, Conn.

[73] Assignee: Design Standards Corporation, Bridgeport, Conn.

[21] Appl. No.: 575,771

[22] Filed: Feb. 1, 1984

[51] Int. Cl.[4] ..... A63C 5/04

[52] U.S. Cl. ..... 280/602; 280/607; 280/609

[58] Field of Search ..... 280/609, 608, 607, 602, 280/601, 610

[56] References Cited

U.S. PATENT DOCUMENTS

| | | | |
|---|---|---|---|
| 3,921,994 | 11/1975 | Locati | 280/607 |
| 4,027,895 | 6/1977 | Larsson | 280/609 |

FOREIGN PATENT DOCUMENTS

| | | | |
|---|---|---|---|
| 238074 | 1/1965 | Austria | 280/609 |
| 1450993 | 8/1966 | France | 280/609 |
| 2419085 | 11/1979 | France | 280/608 |

*Primary Examiner*—David M. Mitchell

*Attorney, Agent, or Firm*—Bachman & LaPointe

[57] ABSTRACT

The disclosure teaches a ski having a longitudinal slot extending therethrough and terminating before the forward and rearward edges to form a partially slit ski structure. The partially slit ski structure forms side-by-side inside and outside sliding portions having mating surfaces at the cut faces wherein said cut faces are cut at an angle. Means are provided to flex the inside sliding portions to partially overlap the inside and outside sliding portions.

14 Claims, 8 Drawing Figures

SKI

BACKGROUND OF THE INVENTION

Different speed and maneuverability requirements of modern skiing has necessitated the purchase by skiers of multiple skis with varying degrees of rigidity. Thus, different skiing requirements often necessitate the skier to purchase several different sets of skis in order to adapt to different skiing conditions.

It is highly desirable to develop skis which are suitable for a variety of skiing conditions. In accordance with the present invention, a slotted ski as defined herein has provided the versatility needed to use same under varying skiing conditions. Thus, the slotted ski of the present invention provides necessary firmness on the outside half of the ski and flexibility on the inside half of the ski to make it adaptable to a variety of skiing conditions.

Slotted skis are known in the art heretofore such as, for example, those skis shown in U.S. Pat. Nos. 4,275,904, 4,211,433, 4,027,895, 3,921,994, 3,549,162, 3,520,546 and 3,326,564. However, the slotted skis known heretofore do not provide the versatility and features of the slotted skis of the present invention.

Thus, it is a principal object of the present invention to provide a slotted ski which provides firmness on the outside half of the skis and flexibility on the inside half of the skis and which is suitable for use under a variety of conditions.

It is a further object of the present invention to provide a slotted ski which is suitable for use in high speed straight line skiing and also which provides considerable maneuverability in turning.

It is a further object of the present invention to provide a slotted ski as described heretofore which provides an increase in gripping edges during turning for more bite into the snow.

It is a still further object of the present invention to provide a slotted ski as described heretofore which features the creation of a concavity on the inside edge of the ski when turning to aid in automatic turning.

Further objects and advantages of the present invention will appear hereinbelow.

SUMMARY OF THE INVENTION

In accordance with the present invention, the objects and advantages thereof are readily achieved. The ski of the present invention comprises an upper binding portion to which a ski boot of a skier is intended to be fastened, a lower sliding surface having forward, rearward and side edges, a longitudinal slot extending through said ski and terminating before said forward and rearward edges to form a partially slit ski with side-by-side inside and outside sliding portions having mating surfaces at the cut faces wherein said cut faces are cut at an angle, and means to flex the inside sliding portion to partially overlap the inside and outside sliding portions when the skier is negotiating a turn on said inside sliding portion.

BRIEF DESCRIPTION OF THE DRAWINGS

The present invention will be more readily understood from a consideration of the following illustrative drawings in which.

DETAILED DESCRIPTION

Figure 1:
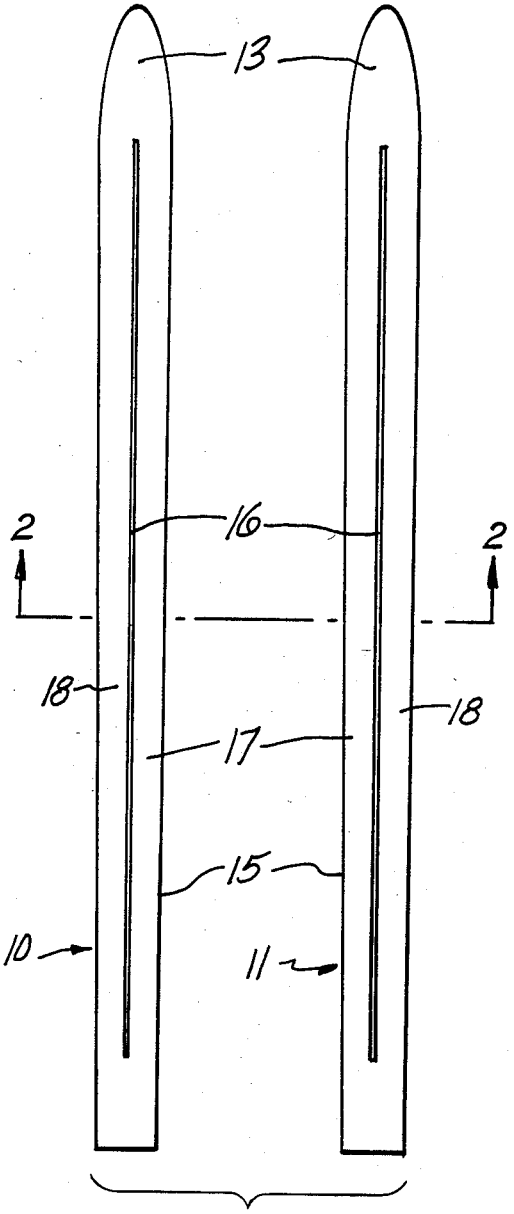
FIG. 1 is a top view of a pair of skis of the present invention in their free state.

In accordance with the present invention, referring to a pair of skis of the present invention, when the skier performs a right turn the inside sliding portion of the left ski flexes and when the skier performs a left turn the inside sliding portion of the right ski flexes. This will be explained more fully in the ensuing discussion.

Thus, referring to the features of the skis of the present invention, preferably the cut faces are cut at an angle of approximately 15° to 25° and generally at an angle of approximately 20°. As can be seen from the drawings, the outside sliding portion has a lower metal edge on the inside and outside portions thereof and the inside sliding portion has a lower metal edge on the outside sliding portion thereof. This provides increased gripping surfaces. Thus, referring to FIG. 6, in a right turn the left ski provides two corresponding edges on the snow. In accordance with the ski of the present invention, the longitudinal slot extends over approximately 70 to 85% of the ski leaving approximately from 10 to 15% of the ski connected at the front and approximately 5 to 10% of the ski connected at the rear. Preferably, the slot comprises approximately 80% of the ski and approximately 12% is connected at the front and approximately 8% is connected at the rear. Also, in accordance with the present invention, the means to flex is preferably a spring operatively associated with the inside sliding portion. An adapter is provided for seating said boot rigidly connected to the outside sliding portion and spaced from the inside sliding portion. Thus, the spring is connected between the inside sliding portion and adapter and is operative under compression to flex the inside sliding portion upwardly. A housing is preferably provided for said spring mounted on said inside sliding portion and penetrating said adapter. A guide means is preferably provided mounted on the inside sliding portion and penetrating the adapter for guiding the inside sliding portion in its flexing movement.

In accordance with the present invention, the ski has inside and outside side portions extending from said forward and rearward edges wherein a concavity is formed at the inside side portion when the inside sliding portion is flexed during a turn on said inside side portion.

Thus, the present invention provides extensive advantages. A single pair of skis can be provided for high speed straight line skiing and also for maneuverability in turning. The skis of the present invention provide an increase in gripping edges during turning for more bite into the snow. Also, the skis of the present invention create a concavity on the inside edge of the ski when turning on said inside sliding portion to aid in automatic turning.

It is a considerable advantage of the skis of the present invention that these skis accommodate the different speed and maneuverability requirements of skiing and mitigate the problem of purchasing multiple skis with varying rigidity for varying skiing conditions. In accordance with the present invention, the slotted ski provides firmness on the outside half of the skis and flexibility on the inside half.

In accordance with the skis of the present invention, in the process of turning, pressure is applied on the bottom of the skis. On the ski that is riding the outside of the turn, the ski halves separate and thereby create two gripping edges and providing the skier with much greater bite into the snow and considerably reducing sideways slippage. As the ski halves separate the inside half of the ski not only flexes upwardly towards the skier but also outwardly to produce a greater concavity on the inside edge of the ski and thereby promote automatic turning. The amount and compression of the flex are controlled in accordance with the present invention by means of adjustable springs between the binding and boot adapter and th flexible inside half of the ski. The outside half of the ski is firm for chatter free straight line skiing at high speeds with no concavity.

The features of the present invention will be more readily seen from a consideration of the drawings.

Referring to FIGS. 1–4, left ski 10 and right ski 11 are shown having a lower sliding surface 12, forward edge 13, rearward edge 14 and side edges 15. Longitudinal slot 16 extends through said ski and terminates before forward edge 13 and rearward edge 14 to form a partially slit ski having side-by-side inside sliding portion 17 and outside sliding portion 18. The inside and outside sliding portions have mating surfaces 19 at the cut faces. The cut faces are cut at an angle and preferably at an angle of 15°–25°. Optimally, the cut angle is about 20°. The reason for the cut angle will be discussed in more detail hereinbelow.

Figure 6:
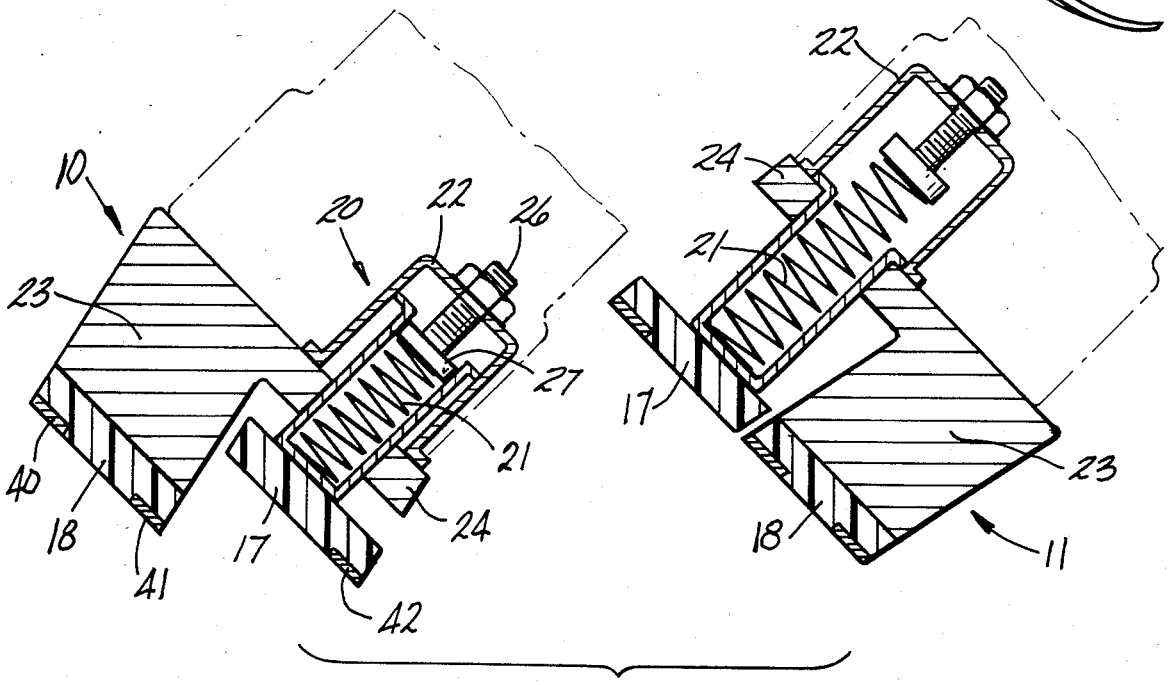
FIG. 6 is a sectional end view of a pair of skis of the present invention forming a right turn with the left ski flexed.
Figure 7:
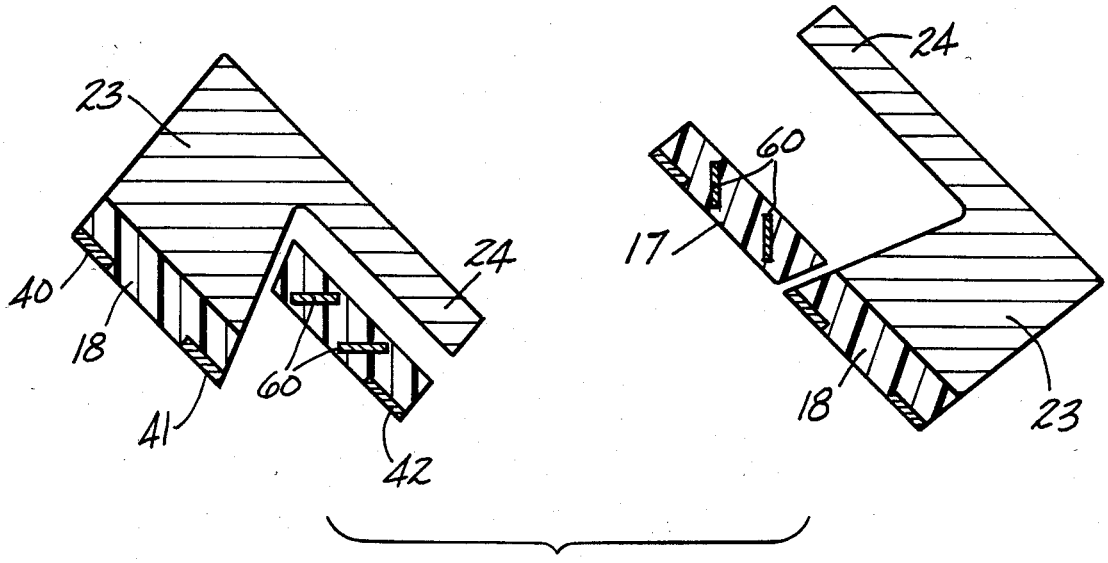
FIG. 7 is a partly schematic sectional view of a modification of the present invention.

As shown in FIG. 6, means 20 are provided to flex the inside sliding portion 17 to partially overlap the inside and outside sliding portions when the skier is negotiating a turn on said inside sliding portion. The partial overlap is clearly shown in FIGS. 4 and 6. The means to flex include a spring member 21 positioned in housing 22. Adapter 23 is rigidly connected to outside sliding portion 18 and is spaced from inside sliding portion 17 by means of a flange member 24 extending above said inside sliding portion 17. The adapter seats boot 30. Spring 21 and spring housing 22 are connected between the inside sliding portion 17 and adapter flange 24 and is operative under compression to flex the inside sliding portion upwardly as clearly shown in the left ski of FIG. 6. Thus, as clearly shown in FIG. 6, the inside sliding portion 17 of the left ski 10 flexes when the skier performs a right turn, and the inside sliding portion 17 of the right ski 11 flexes when the skier performs a left turn. Spring 21 preferably includes any suitable adjustment means 25, as screw member 26 and nut members 27, for manually adjusting the compression of spring 21 to accommodate different skiing requirements.

Outside sliding portion 18 has lower metal edges 40 and 41 on the inside and outside thereof, and the inside sliding portion 17 has a lower metal edge 42 on the outside thereof. Thus, when the skier is negotiating a right turn, the left ski 10 or flexing ski exposes two metal edges to the snow surface, namely, metal edges 41 and 42 are exposed to the ski surface providing additional biting edges to the surface of the ski and aiding in stability.

Preferably, longitudinal slot 16 extends over approximately 75–85% of the ski leaving approximately from 10–15% connected at the front and 5–10% connected at the rear. In the preferred embodiment, the longitudinal slot extends over approximately 80% of the ski leaving approximately 12% connected at the front and 8% connected at the rear.

Figure 5:
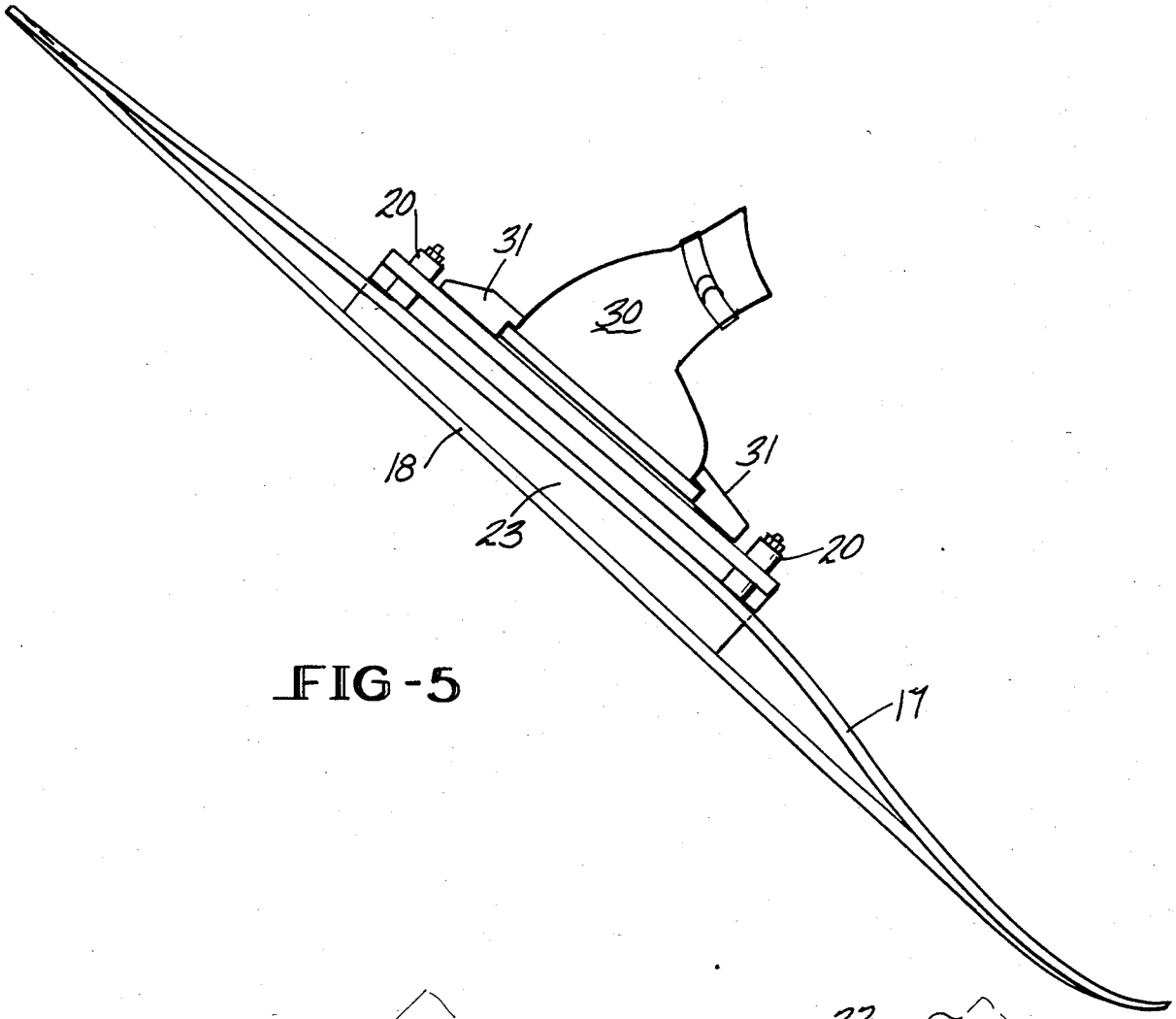
FIG. 5 is a side view of a ski of the present invention in its flexed state.
Figure 8:
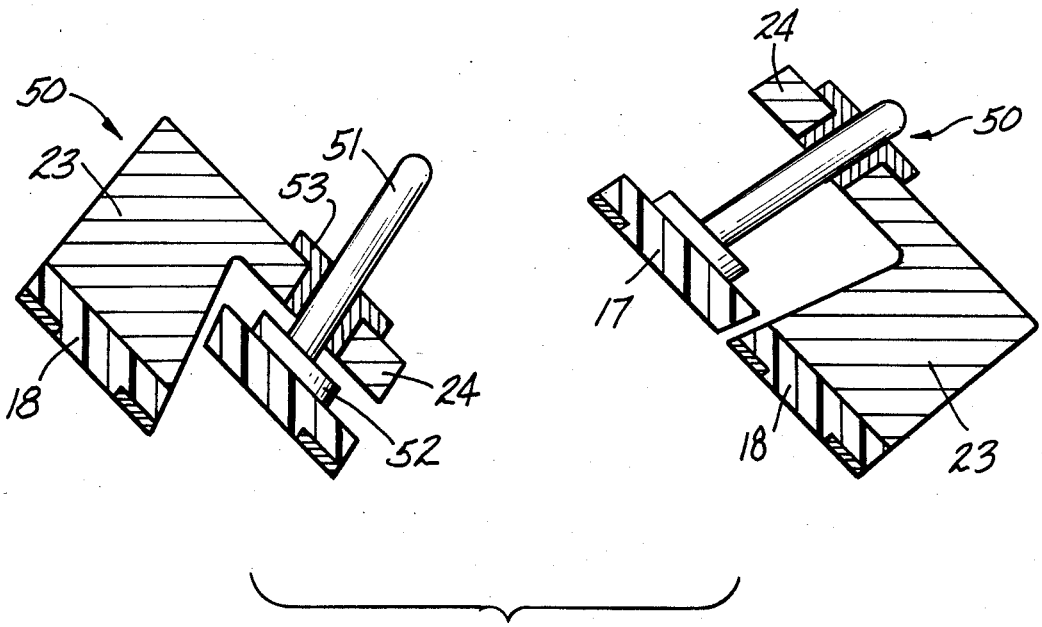
FIG. 8 is a partly schematic sectional end view showing a guide post of the present invention.

Spring 21 and spring housing 22 penetrate adapter flange 24 front and back of boot bindings 31 as clearly shown in FIG. 5. Guide means 50 are preferably mounted on the inside sliding portions 17 as shown in FIG. 8 penetrating said adapter flange 24 to guide the inside sliding portion in its flexing movement. The guide means may, for example, include guide post 51 mounted on inside sliding portion 17 via mounting means 52 mounted on inside sliding portions 17. Post 51 traverses guide bushing 53 which penetrates adapter flange 24 and is mounted thereon. The guide post may be connected either in front of or behind bindings 31 and serve to provide a positive guiding movement to the flexing ski.

In addition, preferably at least one metal rib 60 is included within the inside sliding portion 17 situated at an acute angle facing the inside. The purpose of these ribs is to aid in flexing inside ski 17 in the desired direction.

Figure 3:
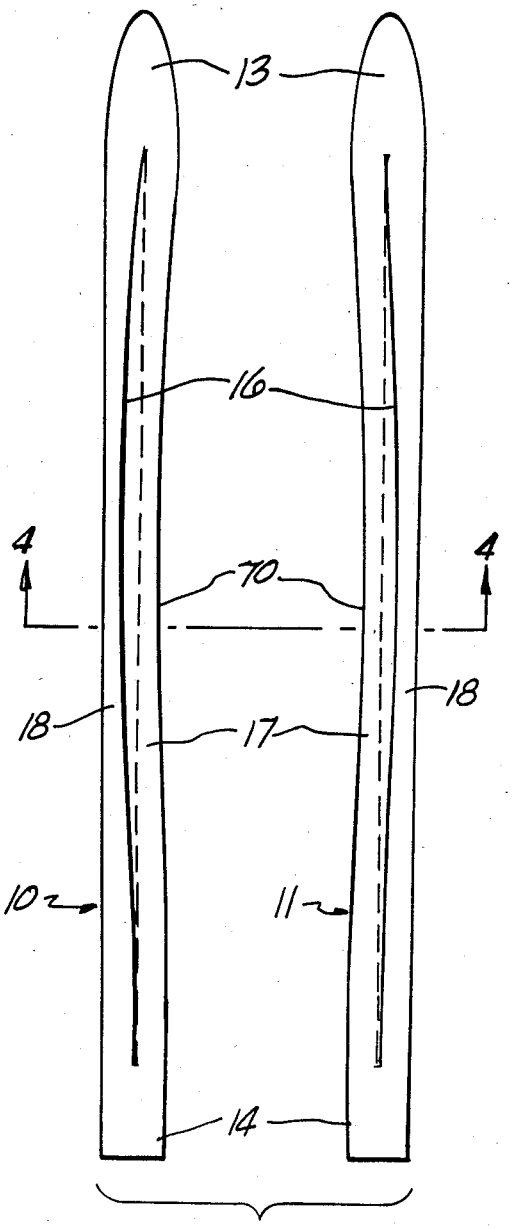
FIG. 3 is a top view of a pair of skis of the present invention in their flexed state.
Figure 2:
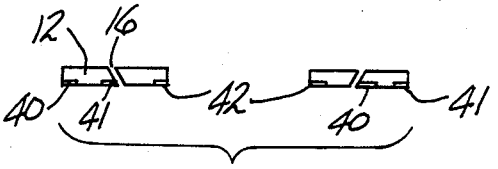
FIG. 2 is a partly schematic sectional view along lines II—II of FIG. 1.
Figure 4:
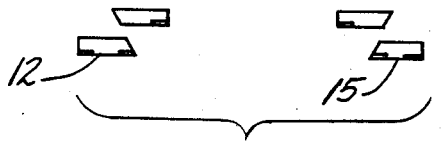
FIG. 4 is a partly schematic sectional view along lines IV—IV of FIG. 2.

A significant advantage of the ski of the present invention resides in the fact that a concavity 70 is formed on the inside side edges 15 when the skier is negotiating a turn on said inside side edges as clearly shown in FIG. 3. This concavity faces the area of the turning radius and has a definite advantage in that it aids or encourages automatic turning.

Thus, in accordance with the skis of the present invention, when turning, the ski on the outside of the turn splits into two halves as a result of the force exerted by the skier onto the ski. As clearly shown in FIG. 6, the left ski in a right hand turn, the ski on the outside of the turn, splits and creates two biting edges. The other ski maintains a single biting edge. A turn to the left would produce a mirror image of this. Also, a concavity is formed by virtue of the overlapping relationship between the inside and outside sliding portions.

Thus, the skis of the present invention achieve numerous significant advantages. Different speeds and maneuverability requirements of skiing are readily accommodated in a single ski. A greater number of gripping edges are provided which aid the skier in reducing sideways slippage. Moreover, the concavity feature promotes automatic turning. Furthermore, the amount of the flex can be readily controlled by means of the adjustable springs.

This invention may be embodied in other forms or carried out in other ways without departing from the spirit or essential characteristics thereof. The present embodiment is therefore to be considered as in all respects illustrative and not restrictive, the scope of the invention being indicated by the appended claims, and all changes which come within the meaning and range of equivalency are intended to be embraced therein.

What is claimed is:

1. A ski comprising an upper binding portion to which the ski boot of a skier is intended to be fastened, a lower sliding surface having forward, rearward and side edges, a generally centrally located longitudinal slot extending through said ski and terminating before said forward and rearward edges to form a partially slit ski with integral forward and rearward edges and side-by-side inside and outside sliding portions having mating surfaces at the cut faces wherein said cut faces are cut at an angle, and means to flex the inside sliding portion to partially overlap the inside and outside sliding portions when the skier is negotiating a turn on said inside sliding portion.

2. A ski according to claim 1 wherein said cut faces are cut at an angle of about 15°–25°.

3. A ski according to claim 2 wherein said angle is about 20°.

4. A ski according to claim 1 wherein the outside sliding portion has a lower metal edge on the inside and outside thereof and the inside sliding portion has a lower metal edge on the outside thereof.

5. A ski according to claim 1 wherein the longitudinal slot extends over approximately 75–85% of the ski leaving approximately from 10–15% connected at the front and 5–10% connected at the rear.

6. A ski according to claim 5 wherein the longitudinal slot extends over approximately 80% of the ski leaving approximately 12% connected at the front and 8% connected at the rear.

7. A ski according to claim 1 wherein said means to flex is a spring operatively associated with the inside sliding portion.

8. A ski according to claim 7 including an adapter for seating said boot rigidly connected to said outside sliding portion and spaced from said inside sliding portion, wherein said spring is connected between said inside sliding portion and adapter and is operative under compression to flex said inside sliding portion upwardly.

9. A ski according to claim 8 wherein said adapter indludes a flange portion extending above said inside sliding portion.

10. A ski according to claim 8 including a housing for said spring mounted on said inside sliding portion and penetrating said adapter.

11. A ski according to claim 8 including a guide means mounted on said inside sliding portion and penetrating said adapter for guiding said inside sliding portion in its flexing movement.

12. A ski according to claim 1 including a pair of skis wherein the inside sliding portion of the left ski flexes when the skier performs a right turn and the inside sliding portion of the right ski flexes when the skier performs a left turn.

13. A ski according to claim 1 wherein said ski has inside and outside side edges extending between said forward and rearward edges, wherein a concavity is formed by the inside side edge when the skier is negotiating a turn on said inside sliding portion by said inside sliding portion partially overlapping said outside sliding portion.

14. A ski comprising an upper binding portion to which the ski boot of a skier is intended to be fastened, a lower sliding surface having forward, rearward and side edges, a longitudinal slot extending through said ski and terminating before said forward and rearward edges to form a partially slit ski with side-by-side inside and outside sliding portions having mating surfaces at the cut faces wherein said cut faces are cut at an angle, at least one metal rib within said inside sliding portion situated at an acute angle facing inside, and means to flex the inside sliding portion to partially overlap the inside and outside sliding portions when the skier is negotiating a turn on said inside sliding portion.

* * * * *